US007475735B2

(12) United States Patent
Harrall et al.

(10) Patent No.: US 7,475,735 B2
(45) Date of Patent: Jan. 13, 2009

(54) TUBULAR HANGER AND METHOD OF LINING A DRILLED BORE

(75) Inventors: Simon John Harrall, Inverurie (GB); Paul David Metcalfe, Peterculter (GB); Paul Antony Rennison, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 11/615,113

(22) Filed: Dec. 22, 2006

(65) Prior Publication Data

US 2007/0158080 A1 Jul. 12, 2007

Related U.S. Application Data

(63) Continuation of application No. 10/326,474, filed on Dec. 20, 2002, now Pat. No. 7,152,684.

(30) Foreign Application Priority Data

Dec. 22, 2001 (GB) ..... 0130849.3

(51) Int. Cl.
*E21B 43/10* (2006.01)
*E21B 23/00* (2006.01)

(52) U.S. Cl. ..... 166/380; 166/206; 166/207; 166/208

(58) Field of Classification Search ..... 166/206–208, 166/380, 381
See application file for complete search history.

(56) References Cited

U.S. PATENT DOCUMENTS

| | | | |
|---|---|---|---|
| 1,233,888 | A | 7/1917 | Leonard |
| 1,324,303 | A | 12/1919 | Carmichael |
| 1,545,039 | A | 7/1925 | Deavers |
| 1,561,418 | A | 11/1925 | Duda |
| 1,569,729 | A | 1/1926 | Duda |
| 1,597,212 | A | 8/1926 | Spengler |
| 1,880,218 | A | 10/1932 | Simmons |

(Continued)

FOREIGN PATENT DOCUMENTS

| | | |
|---|---|---|
| CA | 2356130 | 6/2000 |

(Continued)

OTHER PUBLICATIONS

PCT Search Report, International Application No. PCT/GB/02/05830, dated Aug. 12, 2003.

(Continued)

*Primary Examiner*—Shane Bomar
(74) *Attorney, Agent, or Firm*—Patterson & Sheridan L.L.P.

(57) ABSTRACT

A method of lining a drilled bore comprises running an expandable first tubular into a bore and locating a portion of the first tubular in an unlined section of the bore and another portion of the first tubular overlapping a portion of an existing second tubular. The first tubular is secured relative to the second tubular while retaining the provision of fluid outlets to permit displacement of fluid from an annulus between the first tubular and the bore wall. An expansion device is then run through the first tubular to expand the first tubular to a larger diameter. Cement is then circulated into the annulus between the expanded first tubular and the bore wall. The fluid outlets are then closed.

20 Claims, 5 Drawing Sheets

U.S. PATENT DOCUMENTS

| | | | | | |
|---|---|---|---|---|---|
| 1,930,825 | A | | 10/1933 | Raymond | |
| 2,383,214 | A | | 8/1945 | Prout | |
| 2,499,630 | A | | 3/1950 | Clark | |
| 2,627,891 | A | | 2/1953 | Clark | |
| 2,663,073 | A | | 12/1953 | Bieber et al. | |
| 2,734,580 | A | | 2/1956 | Layne | |
| 2,898,971 | A | | 9/1959 | Hempel | |
| 3,087,546 | A | | 4/1963 | Wooley | |
| 3,188,850 | A | | 6/1965 | Linthicum et al. | |
| 3,195,646 | A | | 7/1965 | Brown | |
| 3,270,817 | A | * | 9/1966 | Papaila | 166/382 |
| 3,353,599 | A | | 11/1967 | Swift | |
| 3,412,565 | A | | 11/1968 | Lindsey et al. | |
| 3,464,180 | A | | 9/1969 | Pensotti | |
| 3,529,667 | A | | 9/1970 | Malone | |
| 3,669,190 | A | | 6/1972 | Sizer et al. | |
| 3,785,193 | A | | 1/1974 | Kinley et al. | |
| 3,818,734 | A | | 6/1974 | Bateman | |
| 3,911,707 | A | | 10/1975 | Minakov et al. | |
| 4,051,896 | A | * | 10/1977 | Amancharla et al. | 166/123 |
| 4,069,573 | A | | 1/1978 | Rogers, Jr. et al. | |
| 4,127,168 | A | | 11/1978 | Hanson et al. | |
| 4,159,564 | A | | 7/1979 | Cooper, Jr. | |
| 4,288,082 | A | | 9/1981 | Setterberg, Jr. | |
| 4,311,194 | A | | 1/1982 | White | |
| 4,324,407 | A | | 4/1982 | Upham et al. | |
| 4,393,931 | A | | 7/1983 | Muse et al. | |
| 4,429,620 | A | | 2/1984 | Burkhardt et al. | |
| 4,531,581 | A | | 7/1985 | Pringle et al. | |
| 4,588,030 | A | | 5/1986 | Blizzard | |
| 4,697,640 | A | | 10/1987 | Szarka | |
| 4,848,462 | A | | 7/1989 | Allwin | |
| 4,848,469 | A | | 7/1989 | Baugh et al. | |
| 4,862,966 | A | | 9/1989 | Lindsey et al. | |
| 5,014,779 | A | | 5/1991 | Meling et al. | |
| 5,027,894 | A | | 7/1991 | Coone et al. | |
| 5,048,612 | A | | 9/1991 | Cochran | |
| 5,083,608 | A | | 1/1992 | Abdrakhamanov et al. | |
| 5,086,845 | A | | 2/1992 | Baugh | |
| 5,181,570 | A | | 1/1993 | Allwin et al. | |
| 5,220,959 | A | | 6/1993 | Vance, Sr. | |
| 5,271,472 | A | | 12/1993 | Leturno | |
| 5,297,633 | A | | 3/1994 | Snider et al. | |
| 5,366,012 | A | * | 11/1994 | Lohbeck | 166/277 |
| 5,409,059 | A | | 4/1995 | McHardy | |
| 5,435,400 | A | | 7/1995 | Smith | |
| 5,467,826 | A | | 11/1995 | Miller | |
| 5,472,057 | A | | 12/1995 | Winfree | |
| 5,494,106 | A | | 2/1996 | Gueguen et al. | |
| 5,560,426 | A | | 10/1996 | Trahan et al. | |
| 5,667,011 | A | * | 9/1997 | Gill et al. | 166/295 |
| 5,685,369 | A | | 11/1997 | Ellis et al. | |
| 5,695,008 | A | | 12/1997 | Bertet et al. | |
| 5,785,120 | A | | 7/1998 | Smalley et al. | |
| 5,833,001 | A | | 11/1998 | Song et al. | |
| 5,901,787 | A | | 5/1999 | Boyle | |
| 5,918,677 | A | | 7/1999 | Head | |
| 6,021,850 | A | | 2/2000 | Wood et al. | |
| 6,056,536 | A | | 5/2000 | Schad et al. | |
| 6,065,536 | A | | 5/2000 | Gudmestad et al. | |
| 6,070,671 | A | | 6/2000 | Cumming et al. | |
| 6,073,692 | A | | 6/2000 | Wood et al. | |
| 6,085,838 | A | | 7/2000 | Vercaemer et al. | |
| 6,089,320 | A | * | 7/2000 | LaGrange | 166/313 |
| 6,098,717 | A | | 8/2000 | Bailey et al. | |
| 6,189,616 | B1 | * | 2/2001 | Gano et al. | 166/298 |
| 6,223,823 | B1 | | 5/2001 | Head | |
| 6,253,850 | B1 | | 7/2001 | Nazzai et al. | |
| 6,321,847 | B1 | | 11/2001 | Brown | |
| 6,325,148 | B1 | | 12/2001 | Trahan et al. | |
| 6,352,112 | B1 | | 3/2002 | Mills | |
| 6,425,444 | B1 | | 7/2002 | Metcalfe et al. | |
| 6,431,282 | B1 | | 8/2002 | Bosma et al. | |
| 6,446,323 | B1 | | 9/2002 | Metcalfe et al. | |
| 6,446,724 | B2 | | 9/2002 | Baugh et al. | |
| 6,454,013 | B1 | | 9/2002 | Metcalfe | |
| 6,457,532 | B1 | | 10/2002 | Simpson | |
| 6,457,533 | B1 | | 10/2002 | Metcalfe | |
| 6,497,289 | B1 | | 12/2002 | Cook et al. | |
| 6,527,049 | B2 | | 3/2003 | Metcalfe et al. | |
| 6,543,552 | B1 | | 4/2003 | Metcalfe et al. | |
| 6,543,816 | B1 | | 4/2003 | Noel | |
| 6,561,279 | B2 | * | 5/2003 | MacKenzie et al. | 166/381 |
| 6,578,630 | B2 | | 6/2003 | Simpson et al. | |
| 6,598,677 | B1 | | 7/2003 | Baugh et al. | |
| 6,648,075 | B2 | | 11/2003 | Badrak et al. | |
| 6,662,876 | B2 | | 12/2003 | Lauritzen | |
| 6,702,029 | B2 | | 3/2004 | Metcalfe et al. | |
| 6,712,401 | B2 | | 3/2004 | Coulon et al. | |
| 761,518 | A1 | | 5/2004 | Lykken | |
| 6,742,606 | B2 | | 6/2004 | Metcalfe et al. | |
| 7,077,210 | B2 | | 7/2006 | MacKay et al. | |
| 7,111,680 | B2 | | 9/2006 | Duggan | |
| 7,121,352 | B2 | | 10/2006 | Cook et al. | |
| 7,144,243 | B2 | | 12/2006 | Stephenson et al. | |
| 2003/0183395 | A1 | | 10/2003 | Jones | |
| 2004/0244992 | A1 | | 12/2004 | Carter et al. | |
| 2004/0261990 | A1 | * | 12/2004 | Bosma et al. | 166/50 |
| 2005/0000697 | A1 | | 1/2005 | Simpson et al. | |
| 2005/0023001 | A1 | | 2/2005 | Hillis | |
| 2006/0054330 | A1 | | 3/2006 | Ring et al. | |
| 2006/0266531 | A1 | * | 11/2006 | Hepburn et al. | 166/387 |

FOREIGN PATENT DOCUMENTS

| | | |
|---|---|---|
| EP | 0 961 007 | 12/1999 |
| GB | 2 320 734 | 7/1998 |
| GB | 2 326 896 | 1/1999 |
| GB | 2 344 606 | 6/2000 |
| GB | 2 345 308 | 7/2000 |
| GB | 2 347 950 | 9/2000 |
| GB | 2 347 952 | 9/2000 |
| GB | 2 350 137 | 11/2000 |
| GB | 2 382 605 | 6/2003 |
| WO | WO 93/24728 | 12/1993 |
| WO | WO 93/25799 | 12/1993 |
| WO | WO 97/06346 | 2/1997 |
| WO | WO 99/18328 | 4/1999 |
| WO | WO 99/23354 | 5/1999 |
| WO | WO 99/35368 | 7/1999 |
| WO | WO 00/37766 | 6/2000 |
| WO | WO 02/25056 | 3/2002 |
| WO | WO 02/081863 | 10/2002 |
| WO | WO 03/006788 | 1/2003 |

OTHER PUBLICATIONS

GB Search Report, Application No. GB0315997.7, dated Oct. 22, 2003.

* cited by examiner

Embodiment 2
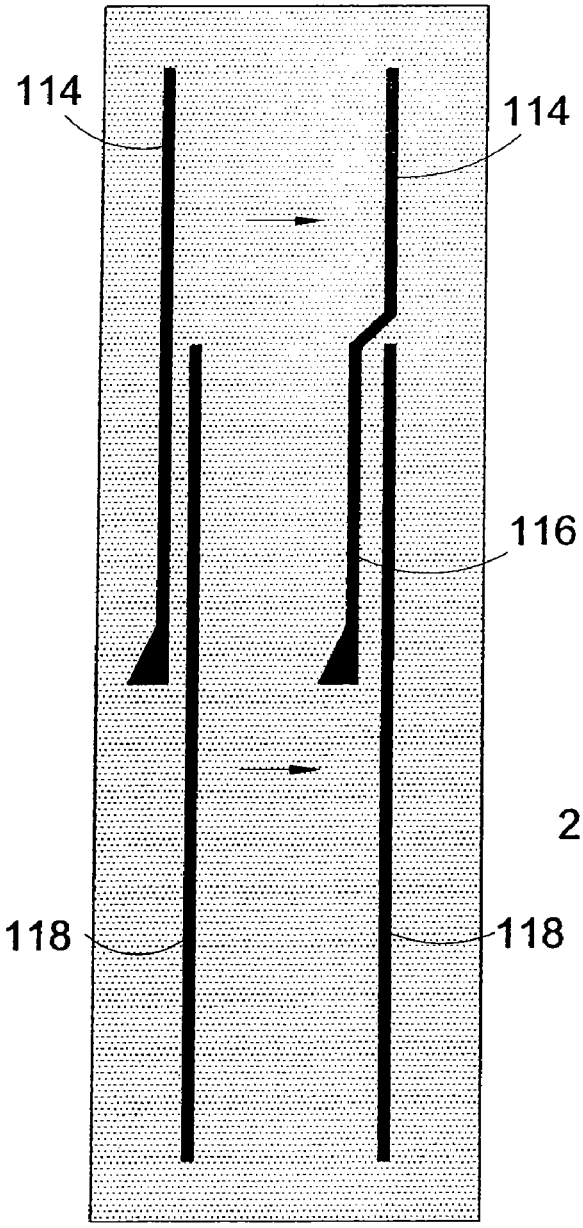
Embodiment 3
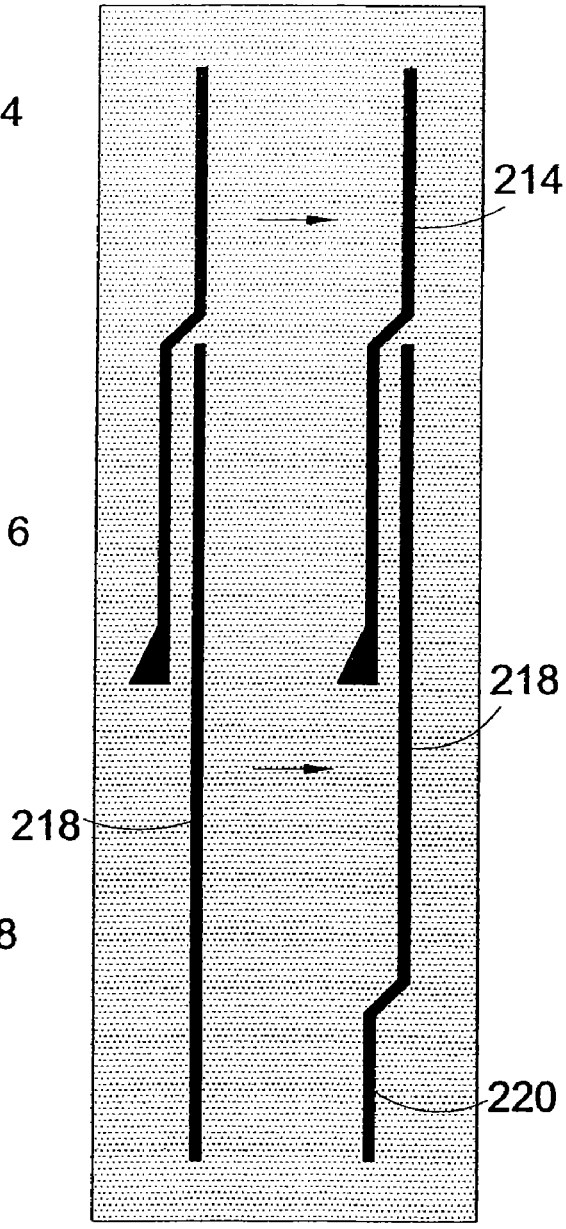
Fig.9 Fig.10 Fig.11 Fig.12

TUBULAR HANGER AND METHOD OF LINING A DRILLED BORE

CROSS-REFERENCE TO RELATED APPLICATIONS

This application is a continuation of U.S. patent application Ser. No. 10/326,474, filed Dec. 20, 2002, now U.S. Pat. No. 7,152,684, which claims benefit of Great Britain Application Serial No. 0130849.3, filed Dec. 22, 2001. Each of the aforementioned related patent applications is herein incorporated by reference.

FIELD OF THE INVENTION

This invention relates to bore liner, and in particular to expandable bore liner.

BACKGROUND OF THE INVENTION

Recent developments in the oil and gas exploration and extraction industries have included the provision of expandable bore-lining tubing. One such system proposes expandable bore liner being run into a section of open hole, below a cased section of bore, such that the upper end of the liner overlaps with the lower end of the existing casing, as described in GB 2 344 606 A. The lower end of the liner is anchored in the bore, and cement slurry is circulated into the annulus between the liner and the bore wall, displaced fluid from the annulus passing through the gap between the lower end of the casing and the upper end of the unexpanded liner. The liner is run into the bore with an expansion cone or swage located at the lower end of the liner and, once the cement slurry is in place, the expansion cone is urged upwardly through the liner, by supplying hydraulic fluid at an elevated pressure behind the cone. This expands the liner to a larger inner and outer diameter, and brings the outer face of the upper end of the liner into contact with the inner face of the lower end of the casing. The cement then cures, sealing and securing the expanded liner in the bore.

There are however a number of potential difficulties associated with this proposal. Firstly, as cementation takes place prior to expansion, there is a risk that the cement will set before expansion has been initiated or completed.

Further, the expansion cone moves upwardly from the lower end of the liner, such that any expansion problems may result in the cone becoming stuck part way through the liner. Access to remedy the problem is then restricted by the presence of the cone and the smaller diameter unexpanded liner above the cone.

Circumferential expansion of the liner using a cone results in axial shrinkage of the liner. Thus, difficulties may be experienced if the liner becomes differentially stuck in the bore, that is if there is a differential pressure between the bore and a formation intersected by the bore, and this pressure differential acts on the liner to hold the liner against a portion of the bore wall. The axial shrinkage of the liner will thus be resisted between the differentially stuck portion of the liner and the anchor at the lower end of the liner. This may result in the liner breaking, or in the expansion process being curtailed with the cone only part-way through the liner.

The use of pressure to urge the cone through the liner relies upon the maintenance of pressure integrity below the cone. Connections between liner sections will be subject to expansion, and should a connection leak following expansion, the expansion process may be hindered or halted. Furthermore, a sudden failure of a connection may expose the surrounding formation to undesirable elevated pressure, potentially damaging the formation and impacting on its production capabilities. Furthermore, if the formation is fractured, there may a loss of fluid into the formation, with the associated expense and inconvenience, and potential for damage to the formation.

Furthermore, the use of hydraulic pressure to urge the cone upwardly through the liner relies upon the provision of a pressure-tight seal between the cone and the liner, and thus requires the liner to conform to tight tolerances on the liner internal diameter, wall thickness and roundness. These tolerances are much tighter than standard API specifications, and consequently make manufacture of such liner relatively expensive.

Finally, when expanding a liner overlapping an existing casing utilising a cone or swage it is only possible to expand the liner to a diameter smaller than the casing, such that any further sections of liner must be of still smaller diameter.

It is among the objectives of embodiments of the present invention to obviate or mitigate these and other disadvantages of existing liner expansion proposals.

SUMMARY OF THE INVENTION

According to a first aspect of the present invention there is provided a method of lining a drilled bore, the method comprising:

running an expandable first tubular of an external first diameter into a bore;

locating the first tubular in an unlined section of the bore with an upper end of the first tubular overlapping a lower end of an existing second tubular of an internal second diameter larger than said first diameter;

securing the upper end of the first tubular relative to the lower end of the second tubular while retaining fluid outlets to permit displacement of fluid from an annulus between the first tubular and the bore wall;

running an expansion device down through the first tubular to expand the first tubular to a larger diameter;

circulating cement into the annulus between the expanded first tubular and the bore wall;

sealing the upper end of the first tubular to the lower end of the second tubular.

Expanding the first tubular prior to cementation avoids any problems relating to the cement setting prior to expansion. Furthermore, as the expansion is carried out "top down", if any difficulties are experienced the expansion device is relatively easily accessed.

In other aspects of the invention it is not necessary to cement the liner in place, for example the liner may be expanded to conform to the surrounding bore wall, or the liner may carry or be provided with a sleeve of deformable or expanding material, such as an elastomer which may be formulated to swell on exposure to selected fluids or temperatures.

Preferably, the first tubular is expanded by rotary or rolling expansion, that is an expansion device featuring one or more rotatable expansion members, the device being rotated within the tubular as the device is axially advanced there through. Examples or such rotary expansion devices are described in applicant's WO00\37766 and U.S. Ser. No. 09/469,690, the disclosures of which are incorporated herein by reference. Such expansion devices operate using a different expansion mechanism than cones and swages, that is by reducing the wall thickness of the tubular and thus increasing the diameter of the tubular, rather than simple circumferential extension of the tubular wall. Such devices may be controlled to limit the degree of axial shrinkage or contraction of the tubular during expansion, and thus the impact of any differential sticking is reduced, and the different yield mechanism of rotary expansion is also better able to accommodate localised differential sticking. The rotary expansion device may be compliant, that is be capable of expanding a variable diameter, or of fixed diameter. However, in certain embodiments of the invention, expansion cones or swages may still be utilised to expand the first tubular, or an axial compliant expander may be utilised, such as the tool sold under the ACE trade mark by the applicant, or the tool as described in the PCT and United States patent applications filed on 30 Nov. 2002, based on applicant's UK patent application 0128667.3.

The first tubular may be expanded by a combination of mechanical and hydraulic means, as described in applicant's PCT patent application WO02\081863.

Preferably, the upper end of the first tubular is expanded to an internal diameter sufficient such that there is little or no reduction in internal diameter between the second tubular and the expanded first tubular. This may be achieved in a number of ways. The lower end portion of the second tubular may describe a larger diameter than an upper portion of the tubular, to create a "bell-end" or the like, such that the first tubular may be expanded into the bell-end. Alternatively, the upper end of the first tubular may be expanded within the lower end of the second tubular and induce expansion and deformation of the second tubular.

Preferably, the upper end of the first tubular is expanded to secure the upper end of the first tubular relative to the lower end of the second tubular. Most preferably, the upper end of the first tubular is further extended to seal the upper end of the first tubular to the lower end of the second tubular.

The lower end of the first tubular may be expanded to a larger internal diameter, to accommodate the upper end of a subsequent tubular.

Preferably, the first tubular is liner and the second tubular is casing.

BRIEF DESCRIPTION OF THE DRAWINGS

These and other aspects of the present invention will now be described, by way of example, with reference to the accompanying drawings, in which:

FIGS. 9 and 10 are schematic illustrations of steps in the process of lining a bore in accordance with a second embodiment of the present invention; and FIGS. 11 and 12 are schematic illustrations of steps in the process of lining a bore in accordance with a third embodiment of the present invention.

DETAILED DESCRIPTION OF THE DRAWINGS

Reference is first made to FIGS. 1 to 7 of the drawings, which are schematic illustrations of steps in the process of lining a drilled bore in accordance with a preferred embodiment of the present invention.

Figures 1, 2, 3, 4, 5, 6, 7:
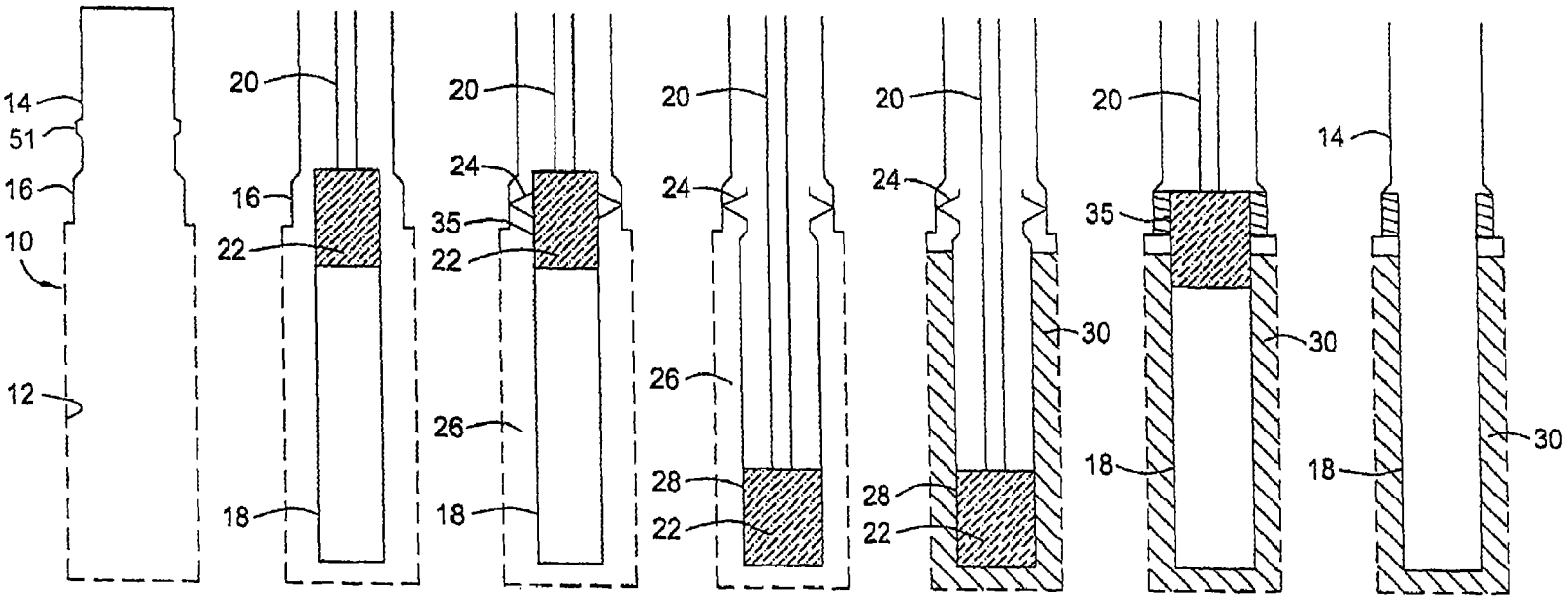
FIGS. 1 to 7 are schematic illustrations of steps in the process of lining a bore in accordance with a preferred embodiment of the present invention.
Figure 8A:
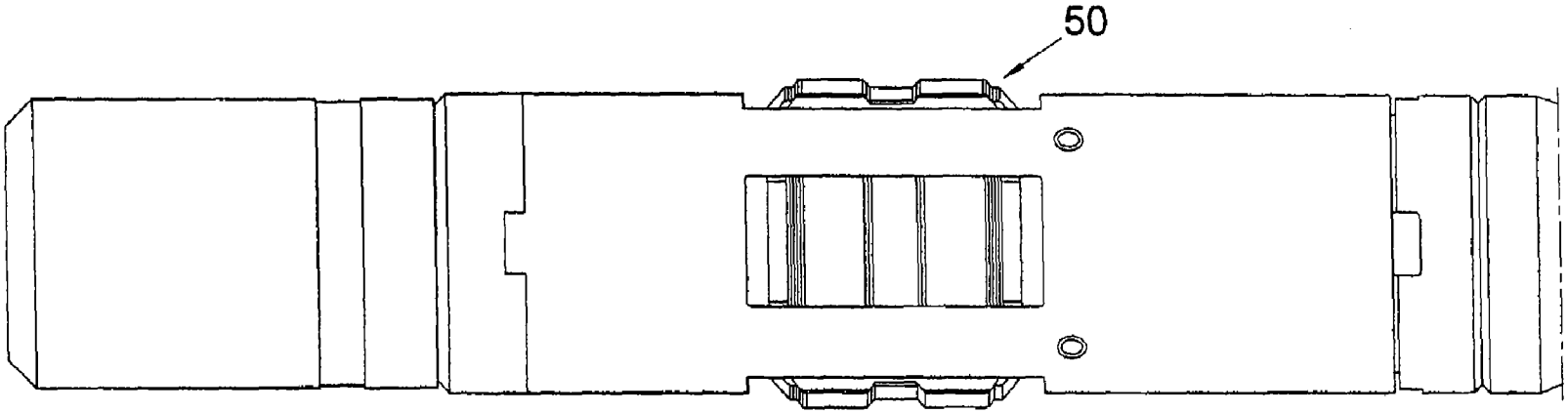
FIG. 8 shows a setting tool suitable for use in the process of FIGS. 1 to 7.
Figure 8B:
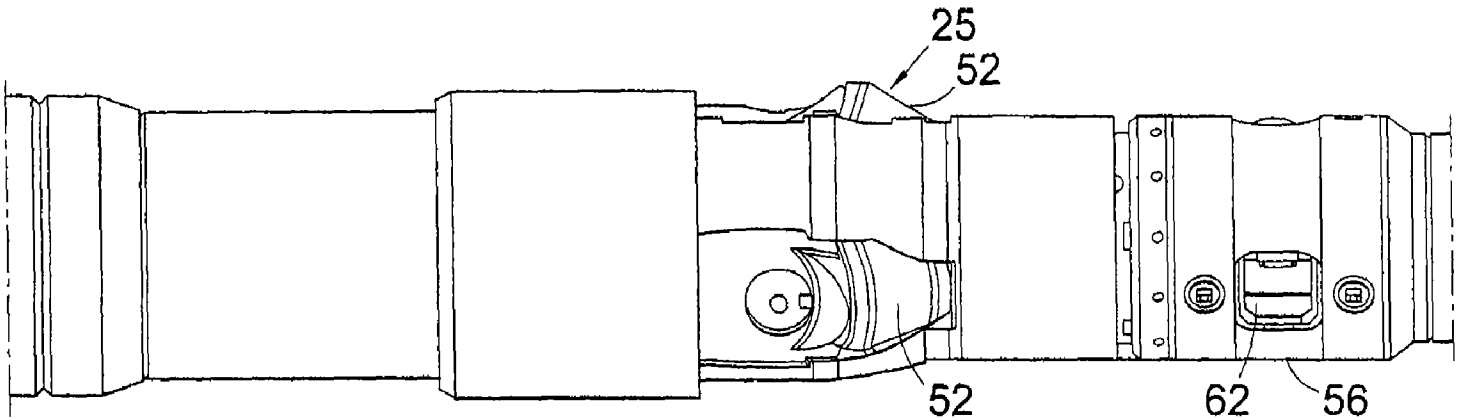
Figure 8C:
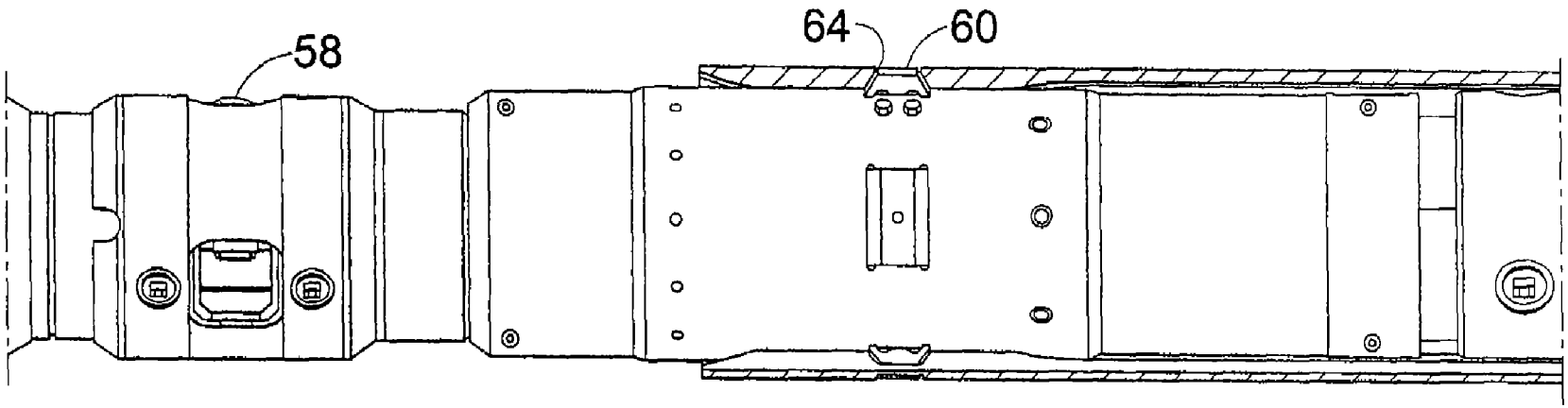
Figure 8D:
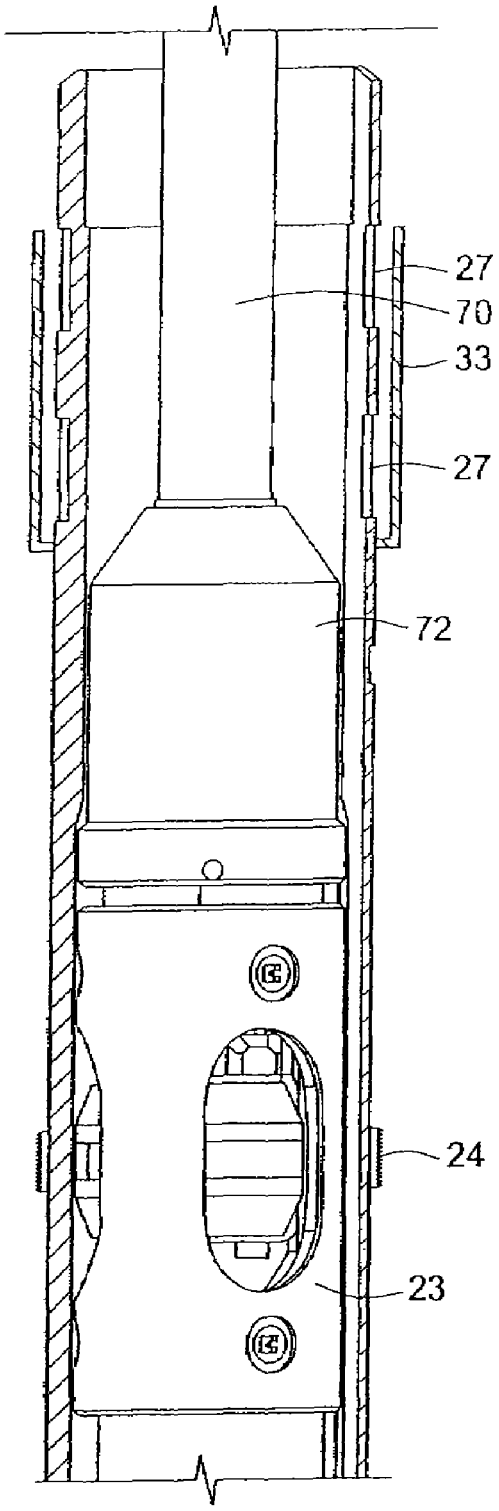
Figure 8E:
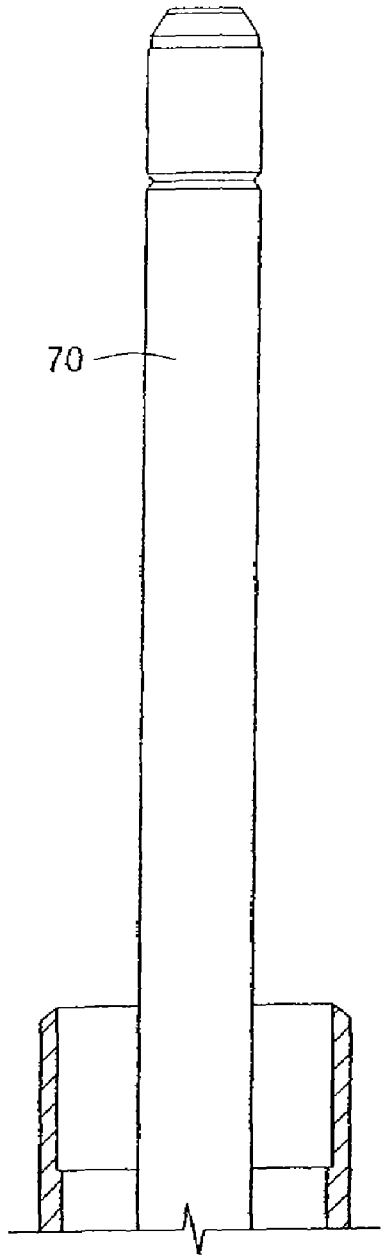

FIG. 1 of the drawings illustrates the lower end of a bore 10 including an open or unlined bore section 12. Above the unlined section 12, the bore 10 has been lined with casing 14, which has been sealed relative to the adjacent bore wall using conventional cementation techniques. It will be noted that the lower end of the casing 14 features a larger diameter end section 16, or bell-end.

FIG. 2 shows a section of expandable liner 18 which has been run into the bore 10 on an appropriate running string 20. The liner 18 is initially coupled to the running string 20 via a setting tool 22 (the tool 22 will be described in greater detail below, following the description of the process, with reference to FIG. 8 of the drawings). The liner 18 is run into the bore 10 on the string 20 and located in the bore such that the upper end of the liner 18 overlaps the larger diameter casing end section 16.

The setting tool 22 includes a fluid pressure actuated compliant rolling expansion device 23 which is rotatably coupled to the string 20 but which is rotatable relative to the setting tool 22 and liner 18. When actuated and rotated, the expansion device 23 extends at least a portion of the upper end of the liner 18 into contact with the casing end section 16, thus providing an anchor 24 for the liner 18. An axial push and pull is then applied to the tool 22 from surface to ensure that the liner 18 is firmly anchored to the casing 14. The setting tool 22 is then released from the now anchored liner 18 and the compliant rolling expansion device 23 utilised to expand the section of liner 18 above the anchor 24, to locate the liner 18 more securely relative to the casing 14. At this stage, an elastomeric seal sleeve 35 below the anchor 24 remains inactive, and a number of fluid ports 27 in the liner remain open to allow fluid to pass from the annulus 26 between the liner 18 and the bore wall between the overlapping ends of the casing 14 and liner 18.

Next, as illustrated in FIG. 4, the setting tool 22 is moved downwardly through the liner 18 and a fixed diameter expansion device 25 is utilised to expand the liner 18 to a larger diameter, such that the expanded inner diameter of the liner 18 corresponds to the inner diameter of the casing 14. The expansion of the liner 18 is achieved using a rolling expansion device 25 but may equally feature one or both of fixed and compliant rolling elements. If compliant rolling elements are present, these are actuated to extend radially outwardly of the tool body by hydraulic pressure supplied to the tool 22 via the running string 20.

The lower end of the liner 18 is provided with an expandable drillable float shoe 28, of a suitable material such a composite or aluminium alloy. The shoe 28 incorporates a float collar with a flapper valve, and the check valves normally found in a shoe. On the setting tool 22 encountering the float shoe 28, a sealed connection is formed with the float collar, the flapper valve is opened and a cement port in the setting tool 22 is opened, such that cement slurry may be pumped down the running string 20, through the setting tool 22, through the float shoe 28, and into the annulus 26, as illustrated in FIG. 5. The fluid from the annulus displaced by the cement 30 passes through the flow ports 27 in the liner 18 below the anchor 24.

Once cementation is completed, the setting tool 22, with the compliant expansion device 23 retracted, is pulled out of the lower end of the expanded liner 18 and the flapper valve in the float shoe closes. Cleaning fluid is then circulated through the liner 18 and casing 14, via the tool 22, to clean out any remaining cement residue. The compliant expansion device 23 is then pulled out until the device 23 is located adjacent the liner seal 35. The expansion device 23 is then actuated to further expand the upper end of the liner 18 into contact with the surrounding casing 14 to activate the seal 35 and close the liner flow ports 27, and thus form a fluid seal between the liner 18 and the casing 14. The setting tool 22 is then pulled out of the bore 10.

As noted above, in this embodiment the casing 14 is provided with a larger diameter lower end section 16, into which the upper end of the liner 18 is expanded, such that the expanded liner 18 has the same internal diameter as the casing 14. For example, 7 inch liner 18 may be run through a 9 inch casing 14. The 7 inch liner 18 may then be expanded to provide the same internal dimensions as the 9 inch liner.

Reference is now made to FIG. 8 of the drawings, which illustrates details of a setting tool 22 as may be utilised in the above-described method. The tool 22 will be described from the top down, starting with FIG. 8*a*.

The upper end of the tool 22 extends above the upper end of the liner 18 and features a location device in the form of a spring-loaded latch 50 which is shaped to locate in a profile 51 (shown by example in FIG. 1 only) provided in the lower end of the casing 14. This serves to indicate when the tool 22, and thus the liner 18, has been correctly located relative to the casing 14; once the latch 50 has engaged the casing profile, an over-pull or additional weight is required to dislodge the latch 50 from the profile. The correct location of the tool 22 and the liner 18 in the casing 14 is important as, for example, if the overlap between the liner 18 and casing 14 is not as intended, it may not be possible to fully expand the liner 18, leaving a restriction in the liner bore. Of course the location device may take other forms, and may utilise sensors relaying signals to surface rather than relying on mechanical engagement.

Below the latch 50 is the fixed diameter expansion tool 25, which in this example features three rollers 52 mounted on inclined spindles. Mounted below the expansion tool 25 are a pair of torque anchors 56, 58, which are rotatably fixed relative to the arrangement for supporting the liner on the tool 22 (FIG. 8*c*), in the form of liner-supporting dogs 60, but which are mounted to the remainder of the tool 22 via a swivel. The anchors 56, 58 comprise rollers 62 which define circumferentially extending teeth. The rollers are mounted on pistons and are each rotatable about an axis which lies parallel to the axis of the tool 22 and the liner 18. The anchors 56, 58 may be hydraulically actuated to extend radially into contact with the inner surface of the casing 14.

The liner-supporting dogs 60 initially extend through windows 64 in the upper end of the liner 18, which will form the liner hanger. The dogs 60 may be released by application of an over-pressure within the tool 22. In this example such an over-pressure shears a disc which then creates an impulse pressure on a dog-supporting sleeve, to move the sleeve to a position in which the dogs may radially retract. However, in other embodiments the dogs may be released by some other means, for example by rotating the tool 22 to the left relative to the anchored liner 18.

The liner-supporting dogs 60 and the torque anchors 56, 58 operate in concert when the compliant expansion device 23 (FIG. 8*d*) is first activated; the elevated pressure utilised to activate the expansion device 23 also serves to activate the anchors 56, 58 to engage with the casing 14, such that when the activated device 23 is rotated to expand the anchor C-ring 24, the liner 18 is held stationary.

Following release of the dogs 60, by application of an over-pressure following activation of the anchor, the rollers 62 allow the actuated anchors 56, 58 to move upwardly relative to the casing 14 as the activated device 23 is utilised to expand the liner 18 above the anchor 24.

A cement stinger 70 (FIGS. 8*d* and 8*e*) is provided below the expansion device 23, and is mounted to the remainder of the lower end of the tool 22 via a swivel 72. Following expansion of the liner 18 the stinger 70 stabs into an appropriate pack-off bushing at the liner shoe 28 to allow cement to be pumped from surface into the annulus 26.

Following cementation and cleaning, as described above, the compliant expansion tool 23 is utilised to further expand the upper end of the liner, and in particular to activate the seal 35 and close the liner flow ports 27. This follows the tool 22 being accurately located relative the upper end of the liner 18 and the casing 14 by means of the latch 50.

Reference is now made to FIGS. 9 and 10 of the drawings, which illustrate an alternative arrangement, in which the casing 114 is initially of substantially constant diameter over its length. However, when the upper end of the liner 118 is expanded to provide a fluid-tight seal between the liner 118 and the casing 114, the lower end of the casing 116 is also subject to a degree of expansion, such that the upper end of the expanded liner 118 describes the same internal diameter as the unexpanded casing 114. To permit such expansion of the casing 114, it is of course necessary that the annulus around the lower end of the casing 114 is free of set cement or other incompressible materials. To this end, it is preferred that the casing has been provided with a shoe, such as described in applicant's PCT\GB01\04202, the disclosure of which is incorporated herein by reference, to retain the lower portion of the casing annulus free of cement.

In other embodiments, the lower end of the casing may be subject to little if any expansion, such that there is a small loss of diameter at the liner top.

Reference is now made to FIGS. 11 and 12 of the drawings, FIG. 11 showing liner 218 which has been expanded in a similar manner to the first described embodiment. However, the lower end of the liner 220 is then subject to further expansion, to facilitate accommodation of a further expanded liner, and such that the further expandable liner may be expanded to a similar internal diameter to the first expanded liner 218 and the existing casing 214. The expansion of the lower end of the liner may be achieved by means of a compliant expansion tool 23, as described above.

In other embodiments of the invention the cementation step may not be required, for example when the liner is provided with an elastomer on its outer face, which elastomer may be formulated to swell on contact with certain fluids to fill the annulus between the expanded liner and the bore wall. In still further embodiments, the cementation may be carried in stages, particularly when the liner is relatively long. In such a situation the expansion may also be carried out in stages, that is a section of liner is expanded and then cemented, and this process is then repeated as many times as is necessary for subsequent sections. Fluid circulation between the annulus and an intermediate section of the liner may be achieved by providing flow ports at appropriate points in the liner, which ports are adapted to be closed on expansion of the liner to a predetermined degree. In one embodiment, an exterior sleeve 33 is provided around the ports 27, allowing fluid to flow through the ports. However, when the liner is expanded the liner is brought into contact with the sleeve 33 and the sleeve closes the ports.

The invention claimed is:

1. A method of lining a drilled bore, comprising:

running an expandable tubing into a wellbore, wherein the expandable tubing is coupled to a running string via a setting tool;

locating the expandable tubing in an existing tubing by engaging a biased latch of the setting tool with a profile provided in the existing tubing;

securing the expandable tubing relative to the existing tubing;

releasing the expandable tubing from the setting tool; and expanding a length of the expandable tubing extending into the drilled bore beyond the existing tubing.

2. The method of claim 1, further comprising circulating cement into an annulus surrounding the expandable tubing.

3. The method of claim 1, wherein securing the expandable tubing includes extending a plurality of expander members of the setting tool in a radial direction.

4. The method of claim 1, further comprising sealing the expandable tubing to the existing tubing by circumferentially expanding the expandable tubing.

5. The method of claim 1, wherein the locating the expandable tubing in the existing tubing includes overlapping a portion of the expandable tubing with a first section of the existing tubing having a larger inner diameter than a second section of the existing tubing when the latch is engaged with the profile.

6. The method of claim 1, further comprising circulating cement into an annulus formed between a previously expanded section of the expandable tubing and a wall of the drilled bore.

7. The method of claim 1, wherein the securing the expandable tubing includes activating an expander of the setting tool to extend the expandable tubing into contact with the existing tubing.

8. The method of claim 1, further comprising expanding a material surrounding the expandable tubing into contact with a wall of the drilled bore.

9. The method of claim 1, further comprising swelling an elastomer surrounding the expandable tubing into contact with a wall of the drilled bore.

10. The method of claim 1, further comprising circulating fluid between the expandable tubing and a bore wall, the fluid being selected to interact with an elastomer and to induce swelling of the elastomer into sealing contact with the wall of the drilled bore.

11. The method of claim 1, wherein the biased latch is movable radially outward from the setting tool by a spring.

12. The method of claim 1, wherein the biased latch is configured to move radially outward from the setting tool due to a spring.

13. A method of lining a bore, comprising:

running an expandable first tubing into a bore;

overlapping a portion of the first tubing with a second tubing located in the bore, the second tubing having a first section with a larger inner diameter than a second section, wherein the first section receives the portion of the first tubing, wherein locating the first tubing in the second tubing includes engaging a biased latch of a setting tool, coupled to the first tubing, with a profile provided in the second tubing;

releasing the expandable first tubing from the setting tool;

expanding the first tubing to provide an expanded first tubing; and circulating cement into an annulus between the expanded first tubing and a wall of the bore.

14. The method of claim 13, further comprising securing the first tubing to the second tubing by expanding the first tubing into the first section of the second tubing.

15. The method of claim 13, further comprising sealing the first tubing to the second tubing by circumferentially expanding the first tubing.

16. A method of lining a drilled bore, the method comprising:

running an expandable first tubing into a bore;

locating a first portion of the first tubing in an unlined section of the bore and a second portion of the first tubing overlapping a first section of an existing second tubing having a larger inner diameter than a second section of the existing second tubing, wherein the locating the first tubing in the second tubing includes engaging a biased latch of a setting tool, coupled to the first tubing, with a profile provided in the second tubing;

securing the first tubing relative to the second tubing;

expanding the first portion of the first tubing to a larger diameter;

circulating cement into an annulus between the first tubing that is expanded and a wall of the drilled bore while permitting displacement of fluid from the annulus through flow ports to an alternate fluid pathway; and closing the flow ports.

17. The method of claim 16, wherein securing the first tubing includes expanding the first tubing into the first section of the second tubing.

18. The method of claim 16, further comprising sealing the first tubing to the second tubing by circumferentially expanding the first tubing.

19. A method of lining a bore, comprising:

running an expandable first tubing into a bore;

overlapping a portion of the first tubing with a second tubing located in the bore, the second tubing having a first section with a larger inner diameter than a second section, wherein the first section receives the portion of the first tubing, wherein locating the first tubing in the second tubing includes engaging a biased latch of a setting tool, coupled to the first tubing, with a profile provided in the second tubing;

expanding the first tubing to provide an expanded first tubing;

retaining fluid outlets to permit displacement of fluid from the annulus after the expanding; and circulating cement into an annulus between the expanded first tubing and a wall of the bore.

20. The method of claim 19, further comprising closing the fluid outlets after circulating the cement.

* * * * *